United States Patent [19]

Fetzer et al.

[11] Patent Number: 4,866,927

[45] Date of Patent: Sep. 19, 1989

[54] PROCESS FOR PRODUCING AN OPEN-END SPINNING ROTOR

[75] Inventors: Gerhard Fetzer, Sussen; Siegfried Kalitzki, Würselen-Bardenberg, both of Fed. Rep. of Germany

[73] Assignee: Fritz Stahlecker and Hans Stahlecker, Fed. Rep. of Germany

[21] Appl. No.: 218,880

[22] Filed: Jul. 14, 1988

[30] Foreign Application Priority Data

Jul. 18, 1987 [DE] Fed. Rep. of Germany ..... 3723901

[51] Int. Cl.[4] ..... D01H 1/135; D01H 7/882; B32B 19/04

[52] U.S. Cl. ..... 57/414; 57/416; 427/234; 427/240

[58] Field of Search ..... 57/400, 401, 404, 414, 57/416; 427/234, 240; 118/55

[56] References Cited

U.S. PATENT DOCUMENTS

| | | | |
|---|---|---|---|
| 4,193,253 | 3/1980 | Herbert et al. | 57/414 |
| 4,358,922 | 11/1982 | Feldstein | 57/414 X |
| 4,358,923 | 11/1982 | Feldstein | 57/414 X |
| 4,397,144 | 8/1983 | Raasch et al. | 57/414 |
| 4,492,077 | 1/1985 | Raasch et al. | 57/414 |
| 4,662,170 | 5/1987 | Raasch | 57/416 |
| 4,679,294 | 7/1987 | Lomax et al. | 427/234 X |
| 4,687,825 | 8/1987 | Sagou | 427/240 X |
| 4,726,413 | 2/1988 | Hellebrand et al. | 118/55 |
| 4,777,813 | 10/1988 | Hoffmann et al. | 57/416 X |

FOREIGN PATENT DOCUMENTS 3339852 5/1985 Fed. Rep. of Germany .

*Primary Examiner*—Donald Watkins
*Attorney, Agent, or Firm*—Barnes & Thornburg

[57] ABSTRACT

A process is provided for producing an open-end spinning rotor assembly. A boron treatment material is applied only to the fiber collecting groove area of the rotor of the spinning rotor assembly. Subsequently, a spinning enhancement material is applied over the boron treated fiber collecting groove and over a sliding wall area of the rotor. An assembly treated with boron treatment material and spinning enhancement material is also provided.

18 Claims, 1 Drawing Sheet

PROCESS FOR PRODUCING AN OPEN-END SPINNING ROTOR

BACKGROUND AND SUMMARY OF THE INVENTION

The invention relates to a process for producing an open-end spinning rotor having a rotor disk made of steel which has a fiber sliding wall expanding conically from an open side to a fiber collecting groove. The fiber sliding wall and the fiber collecting groove are provided with a coating which improves the spinning characteristics.

In order to improve the operating characteristics of an open-end spinning rotor, it is known (German Published Unexamined Patent Application No. 33 39 852) to subject the entire interior surface of the spinning rotor to a boron treatment before the coating is applied that improves the spinning conditions. For this boron treatment, the whole interior space of the rotor disk is filled out with a boron treatment powder. For the layer which improves the spinning conditions, it is known to use a chemically applied nickel coating, in which particles are embedded. The grain size of the particles is approximately 4 μm, and the particles are particularly diamond particles. In practice, it was found that these spinning rotors that were subjected to a boron treatment before the application of the coating that improves the spinning conditions have not had the expected results. In particular, problems have occurred when applying the coating which improves the spinning conditions.

An object of the present invention is to provide an open-end spinning rotor that facilitates the application of a layer improving the spinning characteristics such that the completed rotor meets all expectations with respect to the spinning characteristics and reduced wear.

This object and other objects are achieved by providing a process for applying a layer improving the spinning characteristics in which the boron treatment agent is applied only in the area of the fiber collecting groove prior to applying the spinning improvement layer.

In the spinning rotor construction of the present invention, the coating which improves the spinning conditions can be applied with superior results. The invention is based on the recognition that the cause of the defects in the coating of prior known spinning rotors were microcracks in the area of the fiber sliding surface that had been previously subjected to the boron treatment. Surprisingly, it was found that microcracks of this type, after the boron treatment, were not present in the fiber collecting groove. As a result of the further recognition that the boron treatment and the resulting endeavored increase of wear is not that necessary in the area of the fiber sliding surface, the solution according to the present invention was found.

According to advantageous features of certain preferred embodiments of the invention, it is provided that, before a boron treatment, the fiber collecting groove is filled out with a boron treatment powder. According to certain preferred embodiments, in order to apply the boron treatment powder only in the area of the fiber collecting groove and to hold it there, it is provided that the boron treatment powder is pressed into the fiber collecting groove of a rotating rotor by means of centrifugal forces. In certain preferred embodiments, the amount of the filled-in boron treatment powder is selected such that it fills out the volume of the fiber collecting groove. As a result of the rotation of the rotor, it will then be achieved that the particles of the boron treatment powder will travel exclusively into the area of the fiber collecting groove, without additional measures having to be taken.

According to advantageous features of certain preferred embodiments of the invention, in order to ensure that the boron treatment powder remains exclusively in the area of the fiber collecting groove, during an annealing process, it is provided that the boron treatment powder is held in the fiber collecting groove, during the annealing, by an insert that is placed in the rotor. It is Contemplated that this insert be a spring steel strip that is inserted into the spinning rotor, for example.

According to certain preferred embodiments of the invention, it is provided that the insert is placed in the interior of the rotor as a filler. It is contemplated that this type of a filler be introduced into the spinning rotor in a pulpy or liquid form and then hardened. A requirement of the filler is that it be made of a material that can be easily removed. For example, it is contemplated to use a molding sand such as those used in founding.

Other objects, advantages and novel features of the present invention will become apparent from the following detailed description of the invention when considered in conjunction with the accompanying drawings.

DETAILED DESCRIPTION OF THE DRAWINGS

Figure 1:
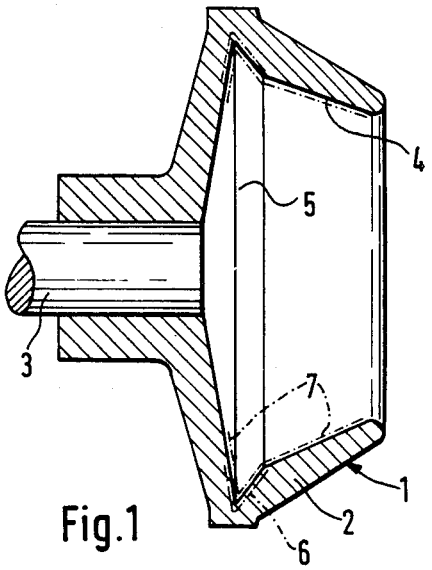
FIG. 1 is an axial cross-sectional view of a spinning rotor which is provided with a coating in the area of a fiber sliding surface and in the area of a fiber collecting groove, that improves the spinning characteristics, according to certain preferred embodiments of the present invention.

The spinning rotor assembly 1 shown in the drawings has a rotor shaft 3 onto which a rotor 2 is pressed. The rotor 2 is made of steel, and is connected with the rotor shaft 3 in a non-rotating way.

The rotor 2 has a fiber sliding wall 4 which extends in a conically expanding way from an open front side to a fiber collecting groove 5. In the shown embodiment, the fiber collecting groove 5 has a triangular cross-section, and represents an expansion with respect to the fiber sliding wall 4. The expansion is enlarged in step-shape. In this area, the interior space of the rotor 2 has its largest diameter. The rotor 2 is completed by a flat conical rotor bottom which may be considered to be an extension of the interior wall of the fiber collecting groove 5. In other embodiments, it is provided that the fiber collecting groove connects to the rotor bottom by means of a step or a bend.

As discussed above, the rotor 2 is made of steel, for example, of a steel alloy. Although this steel alloy offers advantages with respect to strength, it is not advantageous with respect to the spinning characteristics. During the spinning, the fibers slide at the fiber sliding wall 4 and partially also in the fiber collecting groove 5. Therefore, it is necessary to treat this area of the rotor 2 such that it has "fiber-friendly" characteristics, which are called "good spinning characteristics". In this area, the rotor 2 is therefore provided with a coating 7 that has the desired good spinning characteristics. It is known to provide a chemically applied nickel layer as a coating 7 into which particles are embedded that have grain sizes of from 2 to 4 m. In practice, diamond particles are preferred as the embedded particles. However, the use of boron carbide particles or silicon carbide particles is also known.

In practice, since solid particles are often enclosed in the fiber material to be processed, Particularly grains of sand in the case of cotton, the rotor 2 of open-end spinning rotor assemblies 1 are subjected to a relatively high wear. It is therefore endeavored to subject the steel of the rotor 2 which, per se, is more wear-resistant than the previously used aluminum rotors, to an additional hardening. In the embodiment shown, it is therefore provided that the rotor 2 is treated with boron and has an iron boride layer 6 underneath the coating 7, in the area of the fiber collecting groove 5. It is contemplated that this iron boride layer 6 be produced in such a way that it does not cause an interference with the application of the coating 7. It is further contemplated that the thickness of the iron boride layer 6 be in the range of about 20 to 30 m.

Figure 2:
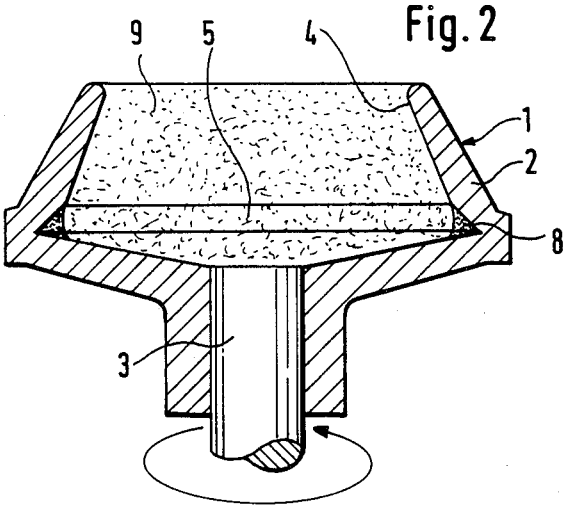
FIG. 2 is an axial cross-sectional view of a spinning rotor during one Phase of the Process according to certain preferred embodiments of the present invention.

So that a boron treatment powder 8 is applied and held exclusively in the area of the fiber collecting groove 5, the measures according to FIG. 2 are provided. The spinning rotor 1 is arranged vertically such that the open side of the rotor 2 points upward. It is then rotated at high rotational speeds such that a boron treatment powder 8 that is placed in the rotor 2 is pressed into the fiber collecting groove 5 by means of centrifugal forces. The filling-in of the boron treatment powder 8 may take place before or during the rotating of the rotor 2. The amounts are provided such that just the cross-section of the fiber collecting groove 5 is filled out.

In order to hold the boron treatment powder 8 in the area of the fiber collecting groove 5 during a subsequent annealing, at least the area of the fiber collecting groove 5 that is filled with the boron treatment powder 8 is covered with an insert. It is contemplated to use inserts of several very different designs. In the shown embodiment, it is provided that a filler 9 is used as the insert that is placed in the interior space of the rotor 2. It is contemplated to use a filler, such as a moistened and hardening foundry sand, such as those known for producing cores for castings.

In practice, the rotor bottom is of little or no importance to the spinning process. Thus, as a contemplated modification of the shown embodiment, it may also be provided that boron treatment powder 8 is filled into the vertically arranged rotor 2 in such a way that its level extends to the transition between the fiber sliding surface 4 and the fiber collecting groove 5.

Also in this case, it is advantageous to cover the area that is filled with boron treatment powder 8 during the subsequent annealing process. During the annealing, which takes place in a controlled atmosphere, the rotor 2 is heated to approximately 900° C. or more.

After the boron treatment including the annealing process, the filler 9 and the boron treatment powder 8 are removed from the rotor 2. Before the coating 7 is applied, the rotor 2 is cleaned thoroughly. This cleaning may take place chemically and/or electrolytically.

The coating 7 is then applied. Any of the known processes for applying a coating 7 can be used in the present invention. Specific coating materials are also known.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. Process for producing an open-end spinning rotor assembly having a rotor of the type having an open side and a conical sliding wall area leading from the open side to a fiber collecting groove area, said process comprising:

applying a boron containing material to only the fiber collecting groove area while leaving the sliding wall area uncoated by boron containing material; and subsequently applying a spinning enhancement material layer over said boron treated fiber collecting groove area and over said uncoated sliding wall area.

2. Process as claim 1, wherein said treating with boron containing material includes filling out the fiber collecting groove area with treatment powder containing boron.

3. Process for producing an open-end spinning rotor assembly having a rotor of the type having an open side and a conical sliding wall area leading from the open side to a fiber collecting groove area, said process comprising:

applying a boron containing material to only the fiber collecting groove area; and subsequently applying a spinning enhancement material layer over said boron treated fiber collecting groove area and over said sliding wall area, wherein said treating with boron containing material includes filling out the fiber collecting groove area with treatment powder containing boron, and wherein said treating with boron containing material includes rotating the rotor after said filling out the fiber collecting groove area such that the powder containing boron is pressed into the fiber collecting groove area by means of centrifugal force.

4. Process as in claim 2, wherein said treating with boron containing material further includes annealing the powder containing boron after said filling out of the fiber collecting groove area.

5. Process for producing an open-end spinning rotor assembly having a rotor of the type having as open side and a conical sliding wall area leading from the open side to a fiber collecting groove area, said process comprising:

applying a boron containing material to only the fiber collecting groove area; and subsequently applying a spinning enhancement material layer over said boron treated fiber collecting groove area and over said sliding wall area, wherein said treating with boron containing material includes filling out the fiber collecting groove area with treatment powder containing boron, wherein said treating with boron containing material further includes annealing the powder containing boron after said filling out of the fiber collecting groove area, and wherein said treating with boron containing material includes holding the powder containing boron in the fiber collecting groove area by holding means during said annealing.

6. Process as in claim 5, wherein said holding of the powder containing boron in the fiber collecting groove area includes using an insert holding means that is placed into the rotor.

7. Process as in claim 5, wherein said holding of the powder containing boron in the fiber collecting groove area includes using an insert holding means in the form of a filler material placed in an interior area of the rotor.

8. Process as in claim 3, wherein said treating with boron containing material includes holding the powder containing boron in the fiber collecting groove area by holding means.

9. Process as in claim 8, wherein said holding of the powder containing boron in the fiber collecting groove area includes using an insert holding means that is placed into the rotor.

10. Process as in claim 8, wherein said holding of the powder containing boron in the fiber collecting groove area includes using an insert holding means in the form of a filler material placed in an interior area of the rotor.

11. Process as in claim 7, further including cleaning prior to said applying of spinning enhancement material layer.

12. Process as in claim 11, wherein said cleaning includes at least one of chemical cleaning and electrolytical cleaning.

13. Process as in claim 11, wherein said cleaning includes removing said filler material and any remaining excess powder containing boron from the rotor.

14. Process as in claim 1, further including cleaning prior to said applying of spinning enhancement material layer.

15. Process as in claim 14, wherein said cleaning includes at least one of chemical cleaning and electrolytical cleaning.

16. Process as in claim 1, wherein said applying of said spinning enhancement material layer includes using a nickel material having particles embedded therein, said particles being at least one of diamond containing particles, boron carbide containing particles and silicon carbide containing particles.

17. Process as in claim 1, wherein said treating with boron containing material includes facing the rotor open side in an upward direction, filling out the fiber collecting groove area with treatment powder containing boron, rotating the rotor such that the powder containing boron is pressed into the fiber collecting groove area by means of centrifugal force.

18. Open-end spinning rotor assembly comprising a spinning rotor including:

a fiber sliding wall area for receiving fibers leading from an open side of said rotor;

a fiber collecting groove area for collecting fibers from said fiber sliding wall area, said fiber sliding wall area extending between the open side of the rotor and said fiber collecting groove area;

a boron containing layer coating disposed only on said fiber collecting groove area with said fiber sliding wall area being free of said boron containing layer coating; and a spinning enhancement material layer disposed over said boron containing layer on said fiber collecting groove area and disposed over said fiber sliding wall area.

* * * * *